United States Patent [19]

Santschi

[11] 4,375,212

[45] Mar. 1, 1983

[54] CONCRETE SAWING MACHINE PROPULSION CONTROL APPARATUS

[75] Inventor: William R. Santschi, Los Angeles, Calif.

[73] Assignee: Longyear Company, Minneapolis, Minn.

[21] Appl. No.: 226,116

[22] Filed: Jan. 19, 1981

[51] Int. Cl.[3] ..... B28D 1/04

[52] U.S. Cl. ..... 125/14; 404/87

[58] Field of Search ..... 125/4, 5, 14; 51/170 PT, 176, 177; 180/315; 404/87

[56] References Cited

U.S. PATENT DOCUMENTS

| | | | |
|---|---|---|---|
| 2,783,789 | 3/1957 | Konway | 125/14 X |
| 2,917,142 | 12/1959 | Thorner | 180/315 X |
| 4,310,198 | 1/1982 | Destree | 125/14 X |

FOREIGN PATENT DOCUMENTS

| | | | |
|---|---|---|---|
| 52-14283 | 2/1977 | Japan | 125/14 |

*Primary Examiner*—James G. Smith

*Attorney, Agent, or Firm*—Clayton R. Johnson

[57] ABSTRACT

A self propelled sawing machine that includes a frame having ground engaging front and rear wheels, an engine driven infinitely variable hydrostatic or mechanical transmission on the frame that is drivingly connected to the rear wheels, a circular saw blade mounted on the frame and drivenly connected to the engine for making cuts in paving or floor materials such as concrete, masonry, etc., a main housing on the frame, a handle connected to one of the main housing and the frame for controlling the direction of movement of the machine, and control mechanism connected to the transmission for controlling the speed and direction of propulsion of the machine. The control mechanism includes a vernier control assembly for coarse and fine adjustment of the forward speed that can be set for a selected optimum speed and manually operable control mechanism connected between the vernier control assembly and transmission that when operated can change the direction and speed of propulsion but that will automatically return to the pre-set optimum condition determined by the setting of the vernier control assembly. The control apparatus also can be used on self propelled walk-behind or ride-on grooving and/or grinding machines.

15 Claims, 6 Drawing Figures

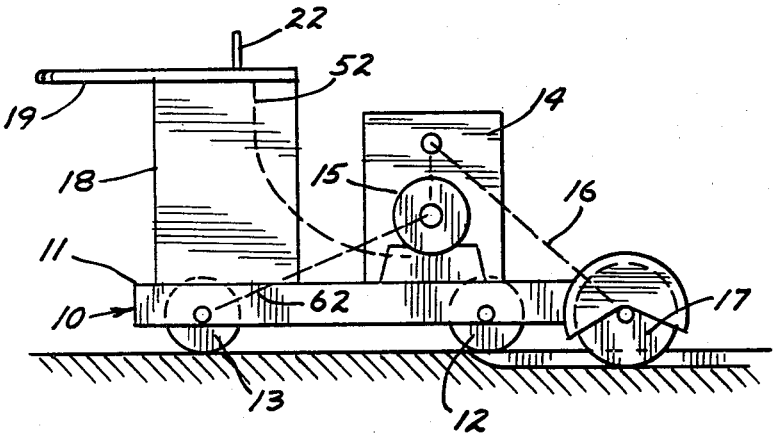
FIG. 1
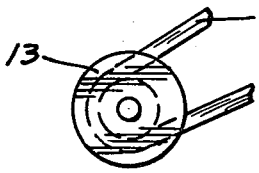
FIG. 2
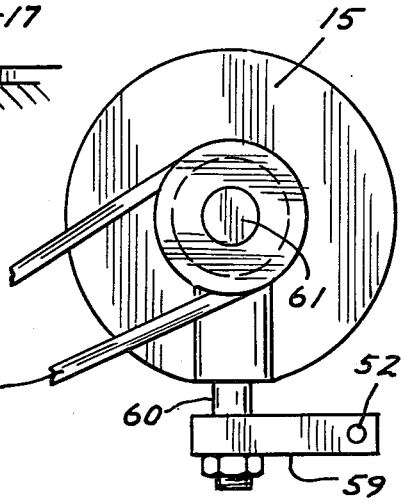
FIG. 6
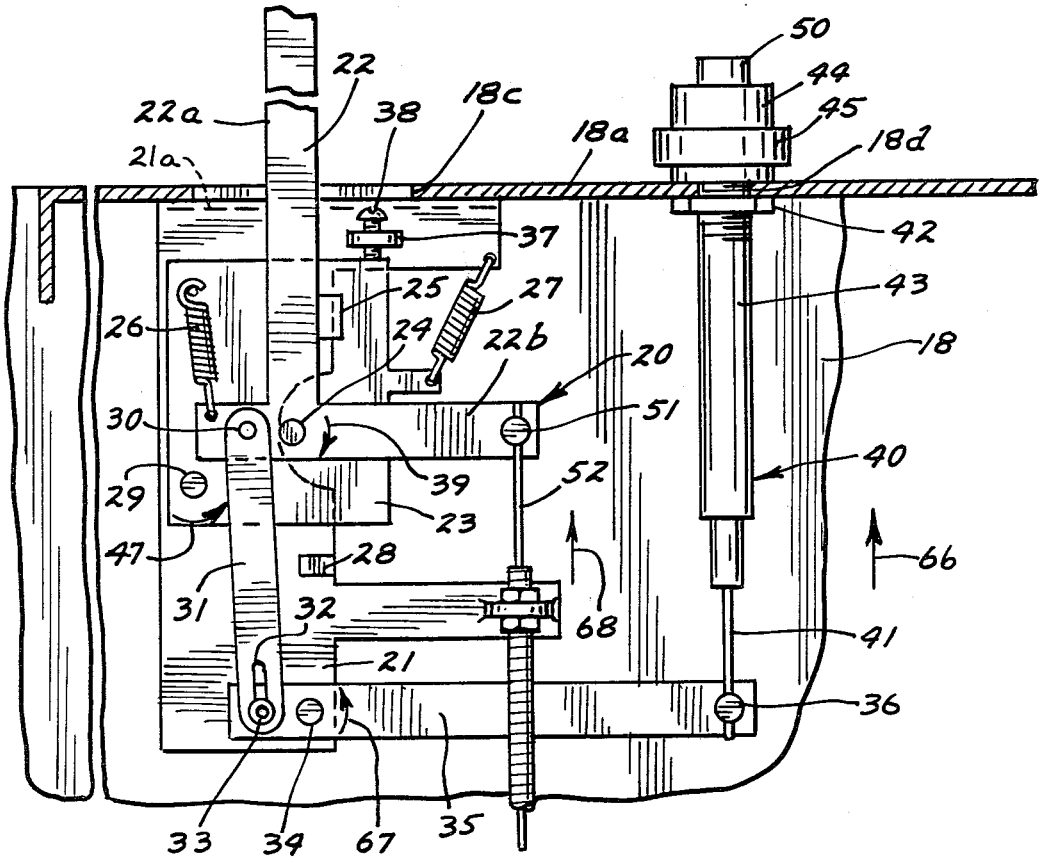

CONCRETE SAWING MACHINE PROPULSION CONTROL APPARATUS

BACKGROUND OF THE INVENTION

Self propelled sawing machines with circular blades are used in the construction industry to make cuts in paving or floor materials such as concrete, masonry, etc. Current machines generally incorporate infinitely variable hydrostatic or mechanical transmissions in their drive trains to transmit power from the engine to the rear wheels for propulsion. The output speed and direction of rotation of the transmission is typically regulated or "shifted" by a remotely located manual control device connected by a linkage or cable to a control shaft on the transmission. The device, usually a lever and/or push-pull/vernier knob, is used by the operator as a coarse control to cause the machine to travel rapidly forward or in reverse for the purpose of maneuvering or positioning the machine for sawing. When operated as a fine control the device permits precise adjustment of forward speed, allowing the operator to set an optimum speed for the particular pavement material being sawn. "Optimum speed" in this case refers to the best overall propulsion speed for sawing when all the interacting variables such as aggregate hardness, machine power, blade design, operator skill, etc., are taken into account.

Optimum speed is determined empirically by the operator, who must subsequently move the control from the optimum setting each time it is necessary to maneuver the machine or if there is a need to make a temporary adjustment in travel speed when characteristics of the material being sawed change abruptly, e.g., steel reinforcing bar. The operator must then attempt to manually return the control to the previous optimum speed setting. However, this takes time in attempting to reach the same travel speed that has been made prior to the temporary adjustment or change of speed necessary to maneuver the machine. As a result, the efficiency of the sawing operation is reduced.

In order to improve the efficiency of a sawing operation as well as obtain other advantages, this invention has been made.

SUMMARY OF THE INVENTION

Propulsion control mechanism for a self propelled sawing machine that includes a vernier control for precision setting of the speed of travel of the machine and manually operated control mechanism for temporary override of the vernier control to obtain propulsion speeds other than the optimum speed and providing automatic return to the optimum speed after release of the manual control.

One of the objects of this invention is to provide new and novel means for controlling the magnitude and direction of propulsion of a sawing machine to provide for increased sawing efficiency and personal safety of the operator. Another object of this invention is to provide new and novel remote manual control means for a hydrostatic or mechanical transmission or pump-/motor combination whereby the output rotation can be varied from zero (neutral) to a maximum in either a clockwise or counterclockwise direction.

A further object of the invention is to provide new and novel means for a sawing machine to enable the machine being moved rapidly in a forward or reverse direction as required when maneuvering to position the machine for sawing, when unloading the machine from a vehicle, etc. Still another object of this invention is to provide new and novel control means on a sawing machine for precision setting of optimum travel speed of the machine for sawing a particular material and temporary override of the precision setting to obtain maximum forward and reverse speeds. In furtherance of the last mentioned object it is another object of this invention to provide for automatic return of the control to the precision setting of machine travel speed after temporary changes in the magnitude and/or direction of propulsion speed have been made by the operator.

Another object of this invention is to provide new and novel control means for a machine that includes a control handle that seeks neutral and prevents the machine from being started or run in reverse or fast forward speed unless the control handle is actively held in the "forward" or "reverse" position by the operator. In furtherance of the last mentioned object, it is a further object of this invention to provide an accessible neutral stop which can be easily adjusted to compensate for wear in the control means linkages. A further object of this invention is to provide new and novel control means for a self propelled sawing machine that has a positive neutral setting when used with transmissions without neutral detents.

BRIEF DESCRIPTION OF THE DRAWINGS

FIG. 1 is a somewhat diagrammatic side view of a self propelled saw machine having the propulsion control apparatus of this invention;

FIG. 2 is a side view of the control apparatus of this invention with the override control lever and the vernier control assembly in neutral positions;

FIG. 6 is a somewhat diagrammatic showing of the transmission and the drive connection therefrom to a rear wheel.

Referring to FIG. 1 there is diagrammatically shown a self propelled concrete or pavement sawing machine, generally designated 10, that is conventional except for the provision of the control apparatus of this invention. The sawing machine 10 includes a frame 11 mounted on front and rear ground engaging wheels 12 and 13 respectively. A motor or engine 14 is mounted on the frame and drivingly connected through a conventional disengageable drive connection 16 to circular saw blade 17 that is rotatably mounted on the frame. The motor is also drivingly connected to a conventional hydrostatic transmission 15 that has a control shaft 60 with a radial control arm 59 keyed thereon, and an output shaft 61. When the control arm is rotated in one direction from its neutral position the rotational speed of the output shaft is increased in one angular direction (forward drive) and when rotated in the opposite angular direction from its neutral position the rotational speed of the output shaft is increased in the opposite angular direction (reverse drive). The output shaft is drivingly connected through a drive connection 62 to the rear wheels to drivingly rotate said wheels. Advantageously the drive connection includes conventional drive disengagement mechanism (not shown) to selectively prevent wheels being drivenly rotated even though the output shaft 61 is rotating.

Figure 3:
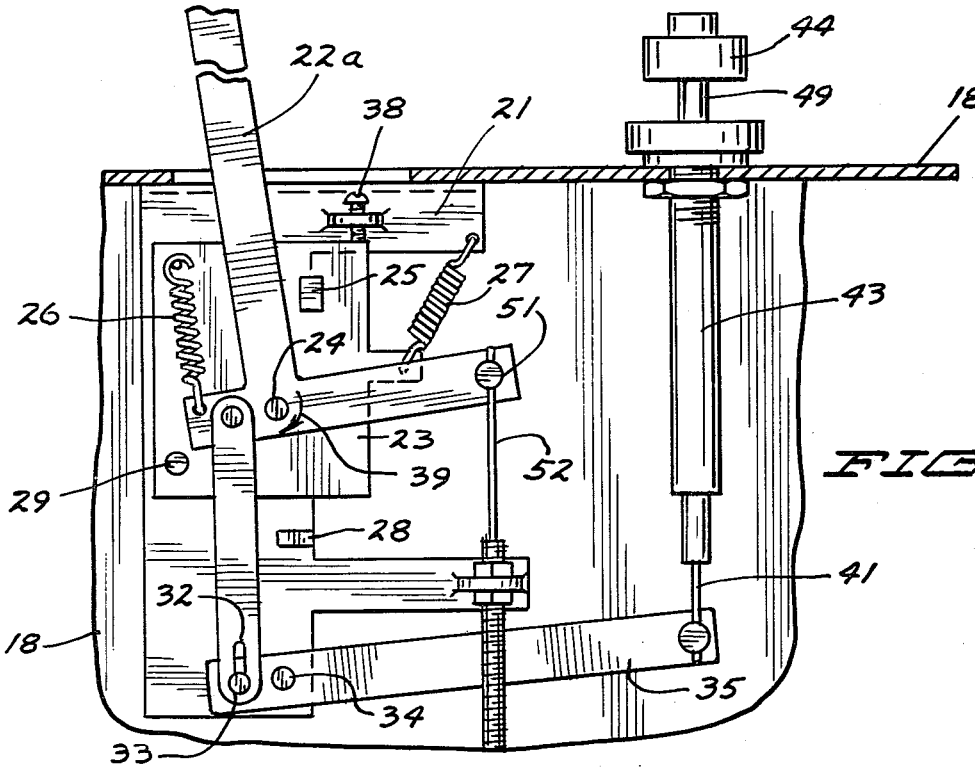
FIG. 3 is a view similar to that of FIG. 2 except the vernier control has been set to control the forward speed.

A housing 18 is mounted on the frame, a pushing and steering handle 19 being attached to the housing, or may be directly attached to the frame. The housing has a top panel 18*a* that mounts the control apparatus of this invention, generally designated 20, and other conventional controls (not shown). The control 20 includes a bracket 21 within the housing that has a right angle leg 21*a* bolted to panel 18*a* and the remainder of the bracket extending in depending relationship thereto. A control lever 22 has a manually movable leg 22*a* extended up through an elongated slot 18*c* in panel 18*a* to extend thereabove, the lower end of the leg 22*a* being joined to an intermediate portion of control lever leg 22*b* to extend at about right angles thereto. Adjacent the juncture of legs 22*a*,22*b*, leg 22*b* is pivotally connected at 24 to a generally central portion of plate 23. One lower corner portion of plate 23 is pivotally connected at 29 to the bracket 21 while an opposite corner portion is abutable against an adjustment screw 38 that is threaded through a lug 37 that is fixed to the bracket.

A spring 26 has one end attached to plate 23 and an opposite end connected to a corner of leg 22*b* for constantly resiliently urging the lever to pivot about pivot 24 in the direction of arrow 39 (clockwise direction as viewed in FIG. 2) to abut against stop 25 that is mounted on the bracket. A spring 27 has one end connected to bracket 21 and an opposite end connected to the plate 23 to resiliently urge the plate to pivot about pivot 29 in the direction of arrow 47 (counterclockwise direction as viewed in FIG. 2) to abut against the adjustment screw. The spring characteristics are such that when no external force is applied to the lever other than by spring 26, the lever is held in abutting relationship to the stop 25 which is mounted on plate 23 and plate 23 is retained in abutting relationship to the adjustment screw (neutral position) by spring 27. The maximum that plate 23 can pivot in the direction opposite arrow 47 about pivot 29 is limited by the plate abutting against stop 28 which is mounted on the bracket.

Intermediate the connection of spring 26 to leg 22*b* and lever pivot 24, a link pivot 30 mounted on said leg pivotally mounts one end of a link 31. The opposite end portion of the link has an elongated slot 32 through which a pivot pin 33 extends for pivotally connecting the link to one end of arm 35 and permit movement of the pivot pin along the length of the slot relative the link to provide a lost motion connection.

An intermediate portion of the arm is pivotally connected to the bracket by a pivot 34, pivot 34 being located on the opposite side of stop 28 from the lever pivot 24. The opposite end of the arm mounts a swivel connection 36.

The spacing of pivot 24 from pivot 30 is substantially the same as the spacing of pivot 34 from pivot 33 while the spacing of pivot 24 from pivot 34 is many times greater than the spacing of pivot 24 from pivot 30. Further, when the controls 22, 40 are in their neutral positions the spacing of pivot 30 from pivot 33 is substantially the same as the spacing of pivot 24 from pivot 34, and leg 22*b* and arm 35 are substantially parallel. The relative locations of the pivot axis of pivots 29, 24, 30, 33, 34 which are parallel to one another provide for a quasi-linear motion of the wire swivel connector 51 and makes possible the override feature dislcosed herein.

A control wire 41 of a conventional vernier control assembly, generally designated 40, is connected to swivel connection 36. Assembly 40 includes a housing 43 extended through opening 18*d* in panel 18*a* and fixed in place by nuts 42 threaded on the housing to abut against opposite sides of the panel 18*a*. A knob 44 is provided on control element 49 (see FIG. 3) which is mounted by the housing 43 and connected to wire 41 while a button 50 is provided on the knob and is resiliently retained in an "out" position on the knob. By depressing button 50 relative the knob the knob together with the control element can be pushed or pulled relative to housing to make a coarse speed setting, while after the button has been released the knob together with the control element may be rotated relative the housing for precision adjustment of the speed setting. A lock nut 45 on the housing can be rotated to firmly lock the control in place. Since assembly 44 is a conventional, for example one sold by Felsted Division of Eaton Corp., the construction and operation thereof will not be described in detail.

The end of lever leg 22*b* which is on the opposite side of lever pivot 24 from link pivot 30 mounts a swivel connector 51 which in turn mounts one end of the transmission control wire 52. The opposite end of wire 52 is attached to the radial outer end of control arm 59 of the transmission for pivoting the arm as the wire is moved.

The particular vernier control assembly shown just controls the forward speed of machine and as shown in FIG. 2 is in its "in neutral" position. Upon depressing the buttom 50 and pulling out on the knob 44, the resulting movement of control wire 41 in the direction of arrow 66 pivots arm 35 in the direction of arrow 67. Since prior to pulling knob 44 the control lever 22 was resiliently retained in its neutral position and pin 33 was bottomed in slot 32 as shown in FIG. 2, the above pivotal movement of arm 35 pulls link 31 whereby lever 22 pivots about pivot 24 in the direction opposite arrow 39 to pull control wire 52 generally in the direction of arrow 68. Wire 52 through transmission control arm 59 rotates control shaft 60 to increase the speed of rotation of output shaft 61 from zero to drive the rear wheels for moving the sawing machine forwardly. After releasing the button knob 41 can be rotated for a precision setting of the propulsion speed for sawing a particular material and the lock nut turned whereby vibrations etc. will not change the vernier control setting.

Figure 5:
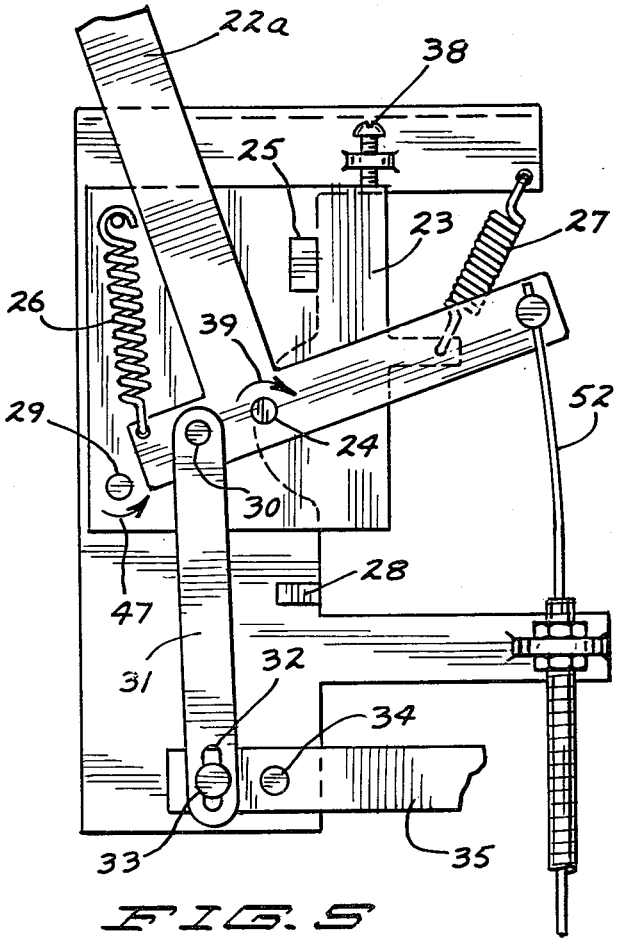
FIG. 5 is a view similar to that of FIG. 4 except that the control lever is shown in its maximum forward speed position.

Now assuming it is desired to increase the speed of propulsion for a period of time without changing the vernier control assembly setting, the control lever 22 may be manually moved to pivot in the direction opposite arrow 39 about pivot 24 from its FIG. 3 position toward its FIG. 5 position until the propulsion speed has been increased the desired amount and manually retained to maintaining the desired increased speed for such a period of time. As the lever 22 is thus moved, plate 23 is retained in abutting relationship with the adjustment screw and the lever pivots about lever pivot 24 in the direction opposite arrow 39 to pull wire 52 in the direction of arrow 68. This results in control shaft 60 being rotated for increasing the rotational speed of the transmission output shaft.

As the control lever is pivoted in the direction opposite arrow 39, link pivot 30 is arcuately moved to be closer to pivot 33 and as a result the link 31 is moved so that the upper end of slot 32 as viewed in FIG. 3 is moved more closely adjacent pivot (pin) 33. The pin 33 is abutting against the upper end of the slot 32 limits the pivotal movement of lever 22 in the direction opposite arrow 39 for any given setting of the vernier control assembly. That is, the maximum speed setting for lever 22 is determined by the length of slot 32. Upon release of the lever, spring 26 will resiliently move the lever in the direction of arrow 39 until pin 33 again bottoms in slot 32, and accordingly if the vernier control assembly was in the FIG. 3 position, the lever would be resiliently moved to the position shown for it in said Figure. On the other hand, if the vernier control assembly was in its neutral position, upon manually releasing the lever it would be resiliently moved from forward speed setting of FIG. 5 to its neutral position abutting against stop 25, as shown in FIG. 2.

Figure 4:
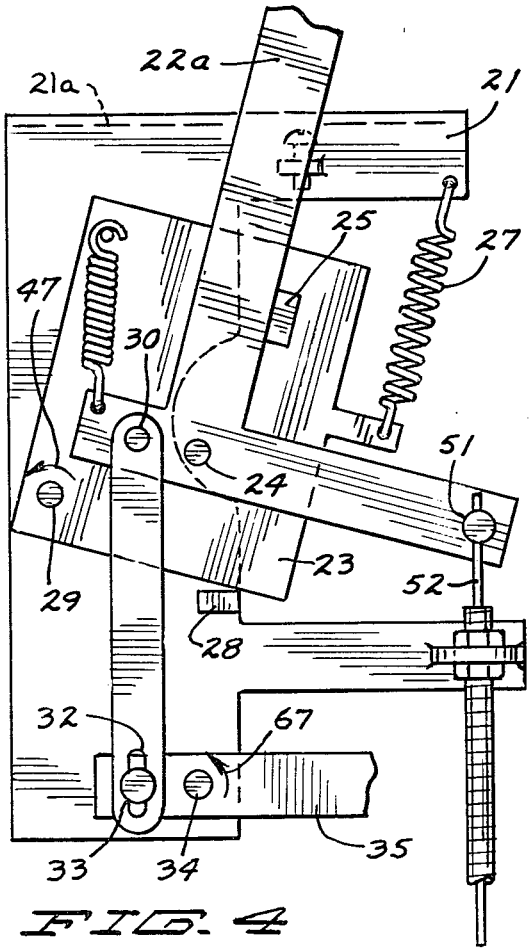
FIG. 4 is a fragmentary side view of the control apparatus of this invention with the override control lever in its maximum reverse speed position.

Assuming lever 22 and the vernier control assembly are both in their neutral positions of FIG. 2 and it is desired to propel the machine rearwardly, the control lever is manually moved in the direction of arrow 39 from its FIG. 2 position towards its FIG. 4 position. Since in the controls' neutral positions lever leg 22*a* abuts against stop 25, the lever cannot pivot about pivot 24 in the direction of arrow 39, but rather plate 23 is pivoted about pivot 29 in the direction opposite arrow 47. This results in pivot 30 being moved closer to pivot 33 and link 31 to move so that the upper end of slot 32 is closer to pivot 33. The length of slot 32 is sufficient that lever 22 can be pivoted until plate 23 abuts against stop 28. The above pivotal movement of lever 22 and plate 23 in the direction opposite arrow 47 does not move arm 35, but does move wire 52 in the direction opposite arrow 68 whereby the control shaft 60 is rotated from its neutral position so that transmission shaft 61 is rotated to drive the rear wheels to propel the machine rearwardly. Upon releasing the control lever, the lever is resiliently returned to its neutral position and shaft 60 rotated to its neutral position.

Assuming the machine is being propelled forwardly (controls in the FIG. 3 are set for a faster forward speed) and it is desired to propel the machine rearwardly without changing the vernier control assembly forward speed setting, the lever cannot be pivoted in the direction of arrow 39 without also pivoting plate 23 in the direction opposite arrow 47 about its pivot 29 since at this time pin 33 is bottomed in slot 22 and the vernier control prevents arm 35 pivoting about pivot 34 in the direction opposite arrow 67. Rather both the lever and plate pivot about their respective pivot until the maximum reverse speed position with the lever moving into abutting relationship with stop 25 at nearly the same time plate 23 abuts against stop 28. Pin 33 remains bottomed in slot 32 during this movement. The above moves wire 52 to rotate shaft 60 from its forward drive position, through its neutral position and to its rearward drive position. Upon releasing the lever, the lever and plate return to their prior positions.

In the event the vernier control assembly is set for a propulsion speed intermediate that of FIG. 3 and neutral, as the lever is moved toward a reverse speed position, initially pin 33 remains bottomed in slot 32, and as a result as the lever pivots in the direction of arrow 39 about pivot 34, plate 23 pivots in the direction opposite arrow 47 about pivot 29. However, lever leg 22*a* abuts against stop 25 before plate 23 abuts against stop 28 and upon the lever abutting against atop 25, the lever no longer pivots about pivot 24, but the combination of the lever and plate continue to pivot about pivot 29. Upon the lever abutting against the lever stop pivot 30 moves more closely adjacent pin 33 and as a result the top of slot 32 moves toward pin 33. The lower the vernier control speed setting from that of FIG. 3, the smaller the amount of movement of the lever that takes place before it abuts against stop 25 and accordingly the closer the top of slot 32 moves toward pin 33 before plate 23 abuts against stop 28. Again upon release of the lever, the plate and lever will be resiliently returned to the positions they were in prior to moving the lever toward a maximum reverse propulsion speed position.

Screw 38 can be adjusted, if necessary, so that when the vernier control is in its neutral position and lever 22 abuts against stop 25, control arm 59 will be in its neutral position at the time plate 23 abuts against the screw. The screw advantageously is located directly beneath slots 18*c* so that the screw can be adjusted by extending a screw driver through slot 18*c*.

With this invention once the forward speed is set by the vernier control, lever 22 will remain in a fixed position until it is manually moved to override the vernier setting. Slot 32 allows additional forward movement of the lever without changing the vernier setting while spring 26 will automatically return the lever to the precision setting provided by the vernier control. Further, due to the lever being pivotally mounted on plate 23 and plate 23 being pivotally mounted on bracket 21, the lever 22 can be moved so that the machine can be driven rearwardly without changing the vernier control forward speed setting while springs 26,27 will automatically return the plate and lever to the vernier control forward speed setting. In the event the vernier control is in its neutral position slot 32 permits reverse movement of lever 22 (direction of arrow 39). Thus lever 22 can be used to manually override the vernier control and upon release the manual control is automatically returned to the preset upstream speed position. It is to be understood that when using the manually override to go from forward to reverse and then to forward, the lever would be manually eased through neutral to prevent jerking of the machine.

The manual override improves efficiency since, for example, the vernier control can be set for the optimum speed for cutting through concrete or other material and when the blade encounters a region of much softer or harder material, i.e. a steel rod, the manual control can be moved to the desired propulsion speed to cut through said region, and then released.

With this invention when the vernier control is in neutral and the lever is manually moved for a forward propulsion speed, the lever only pivots about the forward control pivot 24, spring 27 preventing plate 23 from pivoting about pivot 29. Forward spring 26 serves to return the lever to its neutral position when the lever is released. When the lever is moved from its neutral position for reverse propulsion, due to the lever abutting against stop 25, lever 22 does not pivot about pivot 24, but rather the combination of plate and lever pivot only about reverse control pivot 29, reverse spring 27 serving to return the lever and plate to the neutral position upon release of the lever. The sliding link 31 provides for override capabilities in both forward and reverse modes. Further, the reverse control pivot being separate from the forward control pivot provides for reverse override. The above automatic return of the lever to its neutral position provides a safety "deadman" type of operation when the vernier control is in its neutral position.

With this invention the vernier control provides a microadjustable precise forward speed control. However, the precise setting can be overridden at any time, either forward or reverse, by a small or large amount, at the operator's discretion. When override lever 22 is released, the machine will automatically resume its precisely set propulsion speed without requiring any reference to a scale or other mechanism by the operator.

The control apparatus can also be used on either walk behind or ride-on self propelled machines for grooving and/or grinding concrete, pavement and similar type materials.

What is claimed is:

1. For a self propelled machine that has a frame, a power driven speed to the output shaft, ground engaging wheels mounted on the frame, a drive connection between the output shaft and at least one of the wheels, a power driven tool mounted on the frame for carrying out a work operation such as cutting, grinding or grooving concrete, masonary, pavement and the like, a vernier control assembly that is adjustably setable for controlling the speed of propulsion transmitted from the transmission to the at least one driven wheel and means connected between the vernier control assembly and the transmission that is operated in response to the setting of the vernier control assembly to change the transmission output shaft drive speed, characterized in that the above means includes manually operably means for overriding the vernier control assembly setting to vary the transmission output shaft speed when manually operated and when manually released discontinue the override of the vernier control assembly setting, the manually operable means including a movable transmission control connection connected to the transmission for controlling the transmission output shaft output speed, a manually movable lower movable between at least two positions and means for mounting the lever on the frame and interconnecting the vernier control assembly, the lever and transmission control connection for moving the control connection as the lever is moved between its position while the preselected vernier control assembly setting is maintained.

2. The apparatus of claim 1 further characterized in that one of the at least two lever positions is a neutral position and that the manually operable means includes spring means connected to at least one of the levers and the interconnecting means for constantly resiliently urging movement of the lever to its neutral position.

3. The apparatus of claim 2 further characterized in that mounting and interconnecting means includes a bracket, a first pivot, an arm pivotally mounted on the first pivot and pivotally connected to the vernier control assembly for being pivoted about the first pivot as the vernier control assembly setting is changed and a lost motion connection between the lever and the arm for moving the lever when the vernier control assembly setting is changed to an increased speed while permitting the lever being moved to override the vernier control assembly setting.

4. The apparatus of claim 2 further characterized in that the mounting and interconnecting means includes means for connecting the lever to the transmission control connection for moving it as the lever is moved and means mounting the lever on the frame for pivotally movement between the at least two lever positions.

5. The apparatus of claim 4 further characterized in that the lever at least two positions includes increasing forward drive drive positions and reverse drive positions and that the mounting and interconnecting means includes linkage means between the lever and vernier control assembly for moving the lever to an increasing forward drive position as the vernier control assembly is adjusted to an increase forward speed setting while permitting the lever being manually moved to a forward drive position for a speed faster than the vernier control assembly setting while the vernier control assembly setting is maintained.

6. The apparatus of claim 5 further characterized in that the means for pivotally mounting the lever includes a lever pivot having a pivot axis, and means mounting the lever pivot and pivotally mounted on the frame to pivot about an axis spaced from the lever pivot axis to mount the lever for movement from at least one of its forward drive positions and its neutral position to a reverse drive position while the vernier control assembly is retained at its preselect speed setting.

7. A self propelled machine for cutting concrete, pavement and like materials that includes a frame, a power driven cutting tool rotatably mounted on the frame, a plurality of ground engaging wheels mounted on the frame, a power driven reversible variable speed transmission on the frame that has an output shaft and control means operable for selectively varying the output shaft drive speed between zero and increasing forward driving speeds and zero and increasing rearward driving speeds, a drive connection between the output shaft and at least one of the wheels a vernier control assembly that is adjustably setable for various selected machine propulsion speeds, including neutral and various forward propulsion drive speeds, a transmission control that is connected to the transmission control means and movable for operating the control means between output shaft forward and reverse drive speeds, a control mounting member mounted on the frame, an arm pivotally mounted on the frame and connected to the vernier control assembly for being pivotally moved as the vernier control assembly setting is changed, a manually operated lever movable on the frame and connected to the transmission control for moving it as the lever is moved, said lever being movable between neutral and various forward and reverse drive speeds positions, linkage means connected between the lever and arm for moving the lever from the neutral to a forward speed position as the vernier control assembly in being adjusted from its neutral to a forward speed position moves the arm while permitting the lever being manually moved from the position is moved to as a result of the vernier control assembly forward speed setting without changing the vernier control assembly forward speed setting, and means mounting the lever on the control mounting member for movement between its positions.

8. The apparatus of claim 7 further characterized in that the means for mounting the lever includes a lever mounting member, means for pivotally mounting the lever on the lever mounting member, a stop on the lever mounting member to limit the pivotal movement of the lever relative the lever mounting member in one angular direction and spring means connected between the lever and the lever mounting member to constantly resiliently urge the lever to pivot relative the lever mounting member in said one angular direction.

9. The apparatus of claim 7 further characterized in that the means for mounting the lever includes means mounted on the frame for pivotally movement in one angular direction from at least one of a lever neutral position and lever forward drive position to a lever reverse drive position and spring means connected to at least one of the last mentioned means and the lever to constantly resiliently urge the lever to move to its neutral position.

10. A self propelled machine for carrying out a working operation such as cutting, grinding or grooving concrete, pavement and the like, comprising a frame, a power driven work performing tool rotatably mounted on the frame, a plurality of ground engaging wheels mounted on the frame, a power driven reversible variable speed transmission on the frame that has an output shaft and control means operable for selectively varying the output shaft drive speed between zero and increasing forward driving speeds and zero and increasing rearward driving speeds, a drive connection between the output shaft and at least one of the wheels, a vernier control assembly that is adjustably setable for various selected machine propulsion speeds, including neutral and various forward propulsion drive speeds, a transmission control member that is connected to the transmission control means and movable for operating the control means between output shaft forward and reverse drive speeds, a manually operated lever movable on the frame and connected to the transmission control member to move the control member as the lever is moved, said lever being movable between neutral and various forward drive speed positions and means for mounting the lever on the frame for movement between its positions and connecting the vernier control assembly to the lever for moving the lever from its neutral position to a forward drive speed position as the vernier control assembly setting is adjusted from neutral to a forward drive speed setting.

11. The apparatus of claim 10 further characterized in that the lever is movable to various reverse speed positions for moving the control member to move the control means for output shaft reverse drive speeds and that the means for mounting and connecting the lever includes means connected between the lever and the vernier control assembly and mounted on the frame for mounting the lever for manually movement from the position it is in for a given vernier control assembly setting to the lever reverse position while maintaining the vernier control assembly setting and automatically returning the lever to its position for a given vernier control assembly setting upon manual release of the lever.

12. The apparatus of claim 10, or claim 11, further characterized in that the last mentioned means includes lost motion connecting means between the lever and vernier control assembly for moving the lever to an increased forward lever speed position as the vernier control assembly setting is adjusted to an increased speed setting and permitting the lever being manually moved independent of the vernier control assembly setting to override the vernier control assembly and means for mounting the lever on the frame for manual movement between its positions, including mounting the lever for movement to override the vernier control assembly setting and automatically returning the lever to the position it was in for a given vernier control assembly setting upon release of the lever.

13. The apparatus of claim 12 further characterized in that the last mentioned means includes pivot means having a first pivot axis for mounting the lever for pivotal movement in one angular direction to its increasing forward speed positions, a first stop to limit the movement of the lever about the first pivot axis in the opposite angular direction to the lever neutral position when the vernier control assembly setting is at its neutral setting, and spring means connected to the lever to constantly resiliently urge the lever to pivot to abut against the stop.

14. The apparatus of claim 13 further characterized in that the above pivot means includes a mounting member that mounts the above stop and has the above spring means connected thereto, means for mounting the mounting member on the frame for pivotally movement about a second pivot axis that is spaced from and parallel to the first pivot axis, means having the first pivot axis for pivotally mounting the lever on the mounting member for pivotal movement, said mounting member being pivotally moved in one angular direction about the second pivot axis when the lever is manually moved into abutting relationship to the first stop and spring means connected to the mounting member to resiliently urge it to pivot in the opposite angular direction about the second pivot axis.

15. The apparatus of claim 14 further characterized in that there is provided adjustable means abuttable against the mounting member to limit the pivotal movement of the mounting member about the second pivot axis in the opposite angular direction.

* * * * *